US007649322B2

(12) United States Patent
Neuman et al.

(10) Patent No.: US 7,649,322 B2
(45) Date of Patent: Jan. 19, 2010

(54) LIMITED FLICKER LIGHT EMITTING DIODE STRING

(75) Inventors: Robert C. Neuman, Cannon Falls, MN (US); Steven J. Altamura, Scarsdale, NY (US)

(73) Assignee: Seasonal Specialties LLC, Eden Prairie, MN (US)

( * ) Notice: Subject to any disclaimer, the term of this patent is extended or adjusted under 35 U.S.C. 154(b) by 57 days.

(21) Appl. No.: 11/983,411

(22) Filed: Nov. 8, 2007

(65) Prior Publication Data

US 2008/0116816 A1 May 22, 2008

Related U.S. Application Data

(60) Provisional application No. 60/857,612, filed on Nov. 8, 2006.

(51) Int. Cl.
*F21S 4/00* (2006.01)

(52) U.S. Cl. ..... 315/185 S; 315/312; 315/185 R; 362/565; 362/806

(58) Field of Classification Search ..... 315/185 R, 315/186, 192, 186 S, 209 R, 210, 224, 225, 315/226, 246, 250, 291, 287, 294, 297, 299, 315/300, 301, 302, 306, 307, 312
See application file for complete search history.

(56) References Cited

U.S. PATENT DOCUMENTS

| | | | | |
|---|---|---|---|---|
| 5,777,868 | A | 7/1998 | Gibboney, Jr. | |
| 6,072,280 | A | 6/2000 | Allen | |
| 6,461,019 | B1 | 10/2002 | Allen | |
| 6,830,358 | B2 | 12/2004 | Allen | |
| 6,869,313 | B2 | 3/2005 | Gibboney | |
| 6,972,528 | B2 | 12/2005 | Shao | |
| 7,042,116 | B2 | 5/2006 | Janning | |
| 7,066,628 | B2 | 6/2006 | Allen | |
| 7,250,730 | B1 * | 7/2007 | Allen | 315/185 R |
| 7,265,496 | B2 * | 9/2007 | Allen | 315/185 R |
| 2006/0007679 | A1 | 1/2006 | Allen | |
| 2006/0193131 | A1 * | 8/2006 | McGrath et al. | 362/227 |

* cited by examiner

*Primary Examiner*—Douglas W Owens
*Assistant Examiner*—Jianzi Chen
(74) *Attorney, Agent, or Firm*—Altera Law Group, LLC

(57) ABSTRACT

A limited flicker decorative light-emitting diode (LED) string includes a power plug adapted to connect to an alternating current (AC) power source and supply AC power to the LED string, a first pair of LEDs and a second pair of LEDs, a plurality of LEDs electrically connected in series to form an LED series, and a plurality of rectifying diodes. The plurality of rectifying diodes provides full-wave rectification of the AC power to the LED series and half-wave rectification of the AC power to the first and second pair of LEDs.

16 Claims, 11 Drawing Sheets

LIMITED FLICKER LIGHT EMITTING DIODE STRING

RELATED APPLICATION

The present application claims priority to U.S. Provisional Application No. 60/857,612, filed Nov. 8, 2006, and entitled LIMITED FLICKER LIGHT STRING, which is incorporated by reference herein in its entirety.

TECHNICAL FIELD OF THE INVENTION

The present invention is generally related to a light string that employs light emitting diodes or other illuminating sources that flicker on AC power. More specifically, the present invention relates to a decorative string of light emitting diodes, or other illuminating sources that flicker on AC power, that exhibits enhanced visual characteristics through reduced electronic flicker.

BACKGROUND OF THE INVENTION

Light strings having incandescent lights connected electrically in a series are well known, especially around the holidays when such light strings are used for decorative purposes. More recently, the use of light emitting diodes (LEDs) in place of incandescent lights has become more prevalent. Early versions of LED-based decorative light strings relied upon bulky, external power transformers to convert readily available alternating current (AC) power to direct current (DC) power. The LEDs were typically wired in parallel and with the appropriate DC voltage applied across each LED. Eventually, series connected decorative LED strings that operated directly on AC power became available.

Although these AC-powered LED strings provide desirable characteristics such as high reliability, long life, and low energy consumption, these strings often exhibit a "flickering" effect. This "flicker" results from the LEDs being operated on sinusoidal AC power. As the AC voltage alternates positive and negative, each LED turns on and off with the changing supply voltage. The result is a visible flickering of the LEDs.

FIG. 1 depicts an example of a typical prior art LED string as disclosed in U.S. Pat. No. 6,461,019 issued to Allen. Allen discloses an LED string with one or more series of LEDs connected directly to an AC power source P. In operation, LED series A, comprising LED $\mathbf{1}_A$ through LED $N_A$ is lit for approximately one half of the sinusoidal power cycle, while LED Series B, comprising LED $\mathbf{1}_B$ through $N_B$ is lit during the other half of the power cycle. As such, the LEDs of Series A and B alternately emit light, causing a generally noticeable flicker effect.

Some light strings that operate on AC power attempted to solve the flicker problem through full-wave rectification applied to all the LEDs. This typically mean using a rectifying bridge located in an external enclosure, or in the power plug. FIG. 2 depicts a prior art LED string that utilizes a full-wave bridge rectifier to provide full-wave rectified AC, considered "DC," power to all of the LEDs in the light string. Although flicker can be reduced significantly through such a circuit design, an LED string implementing such a circuit typically requires the use of an external enclosure to house the bridge rectifier. Adding an external enclosure to the LED string adds additional cost and complexity to the LED set, detracts from the decorative value of the light string, and may eliminate certain size-sensitive applications. Further, if such an LED string is to include an end connector for connecting a second string to the end of the first string, the end connector must be directly wired to the plug, requiring more wire than standard light strings.

Alternatively, the bridge rectifier may be added to the power plug. U.S. Pat. No. 5,777,868 issued to Gibboney, Jr., discloses a power plug that includes a built-in bridge rectifier. Using such a power plug with a decorative light string adds significant cost and complexity to what are typically relatively simple devices. In addition to the additional cost, which is partially due to the use of non-standard components, such a plug may not allow the use of current taps which facilitate the stacking of power plugs so that several light strings may be plugged into the same power source.

Another known alternative is to split the bridge, locating one pair of rectifying diodes in the power plug, and one pair in the end connector. Such an LED string is depicted in FIG. 3, and disclosed in U.S. Pat. No. 6,972,528, issued to Shao.

As depicted in FIG. 3, Shao discloses the anodes of a pair of rectifying diodes connected to multiple series-connected LEDs, which in turn are connected to a filtering circuit and another pair of rectifying LEDs. In this embodiment, full-wave rectified AC power, or essentially DC power, is provided to all LEDs. The pair of rectifying diodes nearest the power plug are packaged in the plug, while the other pair of rectifying diodes are packaged with the end connector, or "rear plug". Alternatively, they may be located in their own larger external housing. Although the flicker may be reduced using such methods, non-standard power plugs and end connectors or external housings need to be designed and manufactured.

The difficulties and drawbacks of these known decorative LED strings are overcome by the LED strings and methods of the present invention.

SUMMARY OF THE INVENTION

In one embodiment, the present invention is a limited flicker decorative light-emitting diode (LED) string. A limited flicker decorative LED string includes a power plug adapted to connect to an AC power source and supply AC power to the LED string, a first pair of LEDs and a second pair of LEDs, a plurality of LEDs electrically connected in series to form an LED series, and a plurality of rectifying diodes. The plurality of rectifying diodes provides full-wave rectification of the AC power to the LED series and half-wave rectification of the AC power to the first and second pair of LEDs.

In another embodiment, the limited flicker LED string includes a power plug adapted to connect to an AC power source and supply AC power to the LED string, a first pair of LEDs and a second pair of LEDs, a plurality of LEDs electrically connected in series to form an LED series, and a plurality of rectifying diodes. The plurality of rectifying diodes provides full-wave rectification of the AC power to the LED series and half-wave rectification of the AC power to the first and second pair of LEDs.

In another embodiment, a decorative LED string includes a first power terminal and a second power terminal, and a first diode and a second diode electrically connected in series to form a first diode pair. At least one of the first or second diodes is a rectifying diode and the first pair is electrically connected to the first power terminal. The LED string also includes a third diode and a fourth diode electrically connected in series to form a second diode pair. At least one of the third or fourth diodes is a rectifying diode and the second pair is electrically connected to the first power terminal. A fifth diode and a sixth diode electrically connected in series form a third diode pair, and at least one of the fifth or sixth diodes is a rectifying diode and the third pair is electrically connected to the second power terminal. A seventh diode and an eighth diode electrically connected in series form a fourth diode pair. At least one of the seventh or eighth diodes is a rectifying diode and the fourth pair is electrically connected to the second power terminal. The LED string of this embodiment also includes a plurality of LEDs electrically connected in series to form an LED series. A first LED of the LED series is electrically connected to the first and second diode pairs, and a last LED of the LED series is electrically connected to the third and fourth diode pairs.

In yet another embodiment, a decorative LED string includes: a first power terminal, a second power terminal, and eight diodes. An anode of the first diode is electrically connected to the first power terminal; an anode of the second diode is electrically connected to a cathode of the first diode; an anode of the third diode is electrically connected to the second power terminal; an anode of the fourth diode is electrically connected to a cathode of the third diode, and a cathode of the fourth diode is electrically connected to a cathode of the second diode. A cathode of the fifth diode is electrically connected to the first power terminal; a cathode of the sixth diode is electrically connected to an anode of the fifth diode; a seventh diode, wherein a cathode of the sixth diode is electrically connected to the second power terminal; a cathode of the eighth diode is electrically connected to an anode of the seventh diode, and an anode of the eighth diode is electrically connected to an anode of the sixth diode. The LED string also includes a plurality of LEDs electrically connected in series to form an LED series, wherein a first LED of the LED series is electrically connected to the second diode and to the fourth diode, and a last LED of the LED series is electrically connected to the sixth diode and the eighth diode.

Another embodiment of the present invention is a method of reducing flicker in a decorative LED string that includes providing AC power to a set of terminals of the LED string, and full-wave rectifying the AC power delivered to a first portion of LEDs of the LED string. In this method, the first portion LEDs are electrically connected in series. The method also includes half-wave rectifying the AC power delivered to a second portion of LEDs of the LED string.

In yet another embodiment, the present invention is a reduced flicker LED lighting system. The system of this embodiment includes an AC power source, and a power plug adapted to connect to the AC power source and receive AC power. The system also includes multiple LEDs with a first portion of LEDs and a second portion of LEDs; the first portion of LEDs are electrically connected to form an LED series. Also included in the system is a full-wave rectifier and a half-wave rectifier. The full-wave rectifier provides full-wave rectified AC power to the LED series, while the half-wave rectifier provides half-wave rectified AC power to the second portion of LEDs. The system also includes a wire set electrically connecting the power plug, the multiple LEDs, the full-wave rectifier, and the half-wave rectifier.

Figure 1:
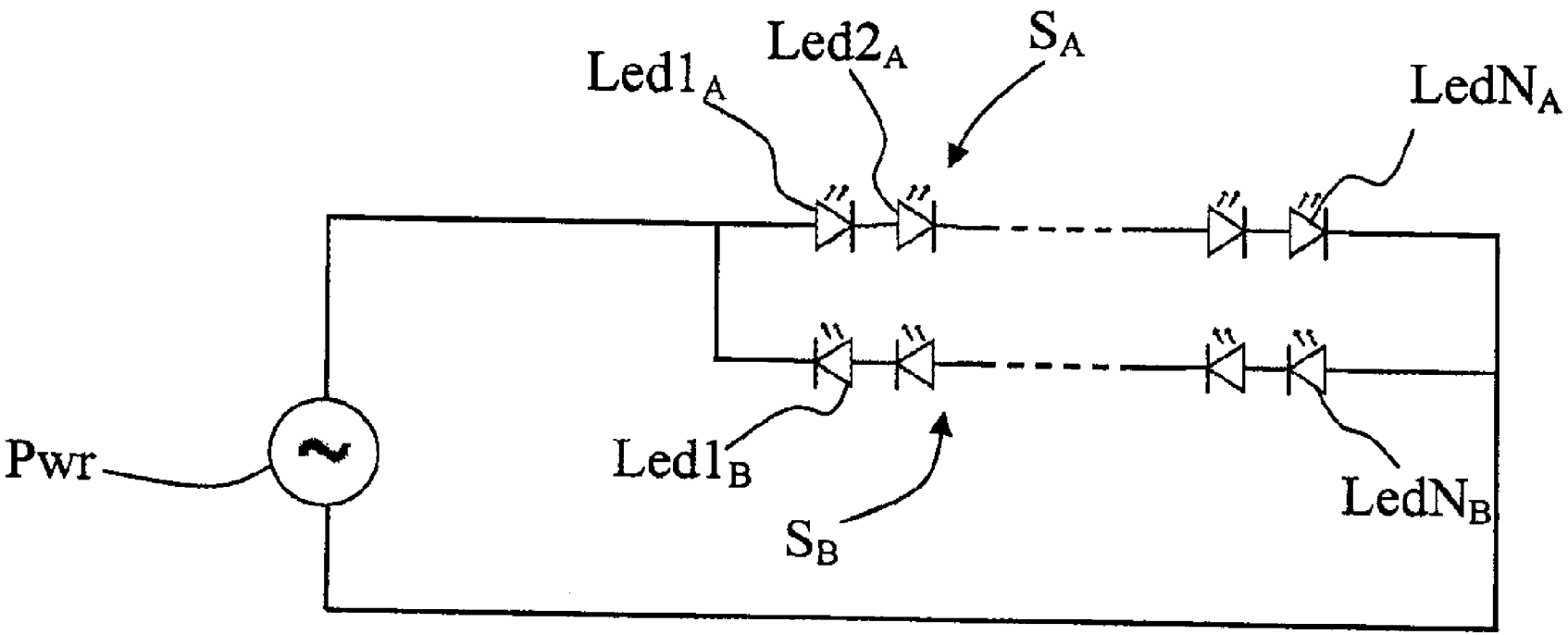
FIG. 1 (Prior Art)
FIG. 1 is a circuit diagram of a prior-art AC-operated LED string without rectification.
Figure 2:
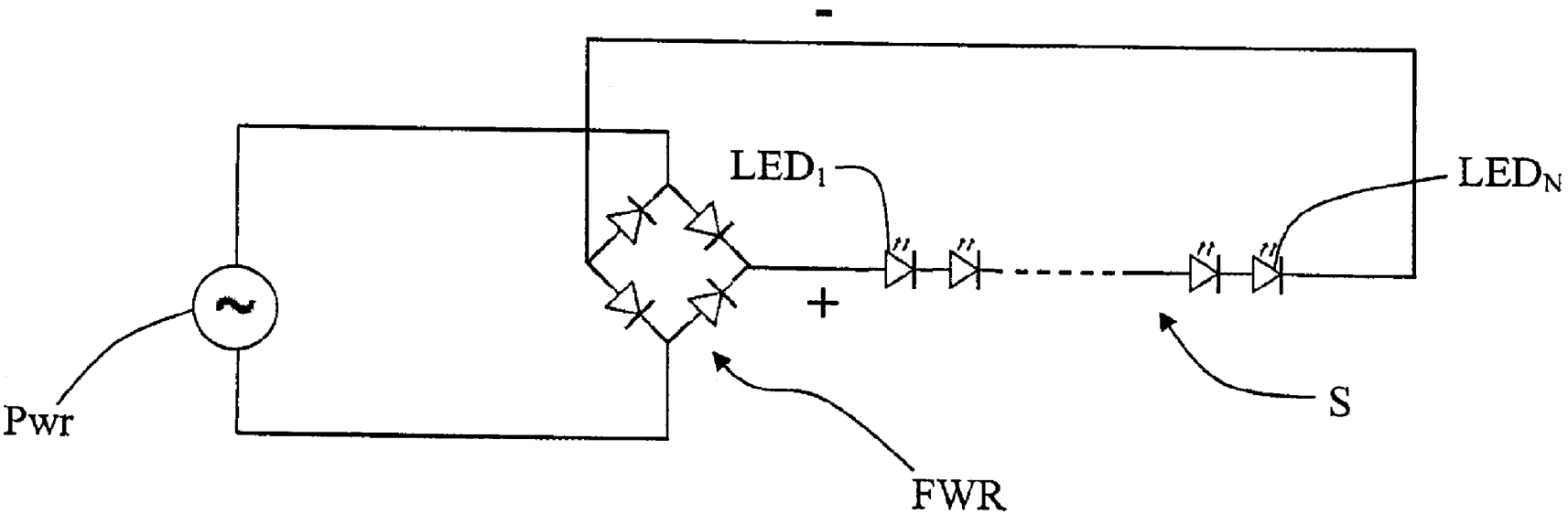
FIG. 2 (Prior Art)
FIG. 2 is a circuit diagram of a prior art AC-operated LED string with a unitary full-wave bridge rectifier supplying full-wave rectification to all LEDs in the string.
Figure 3:
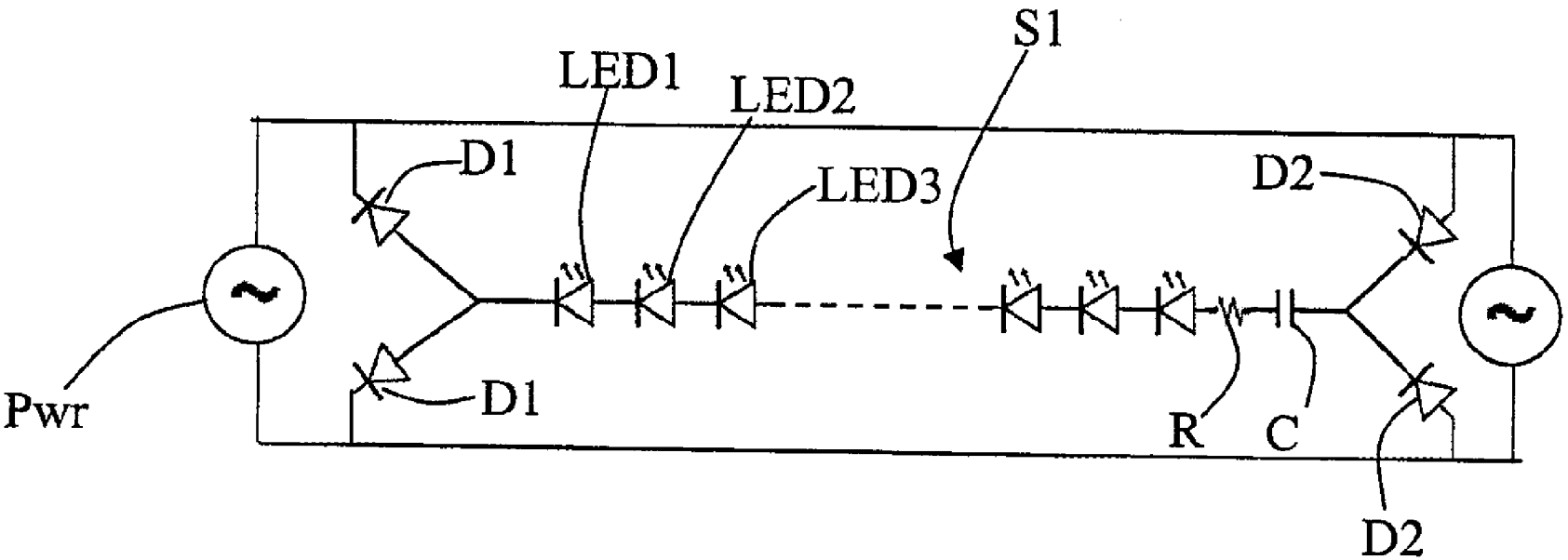
FIG. 3 (Prior Art)
FIG. 3 is a circuit diagram of a prior-art AC-operated LED string with a split bridge rectifier and conditioning circuitry supplying full-wave rectification to all LEDs in the string.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE DRAWINGS

In one embodiment, this invention supplies full-wave rectified alternating current (AC) power to all but four light emitting diodes (LEDs), or light illuminating sources, per circuit, to minimize visible flicker and to increase brightness (as more usable energy is available). It does so without adding extra compartments that can be unsightly, costly, and hard to seal for outdoor environments, by placing the rectifying diodes inside the lamp assembly sockets and utilizing a different wiring connection method not previously used in known series-connected decorative LED strings.

One embodiment of the LED string of the present invention uses lamp sockets to house the rectifier diodes, and uses an alternate wiring connection means to provide DC to almost all of the LEDs. This avoids one extra wire traversing the length of the string as is normally required in end-connected sets. This embodiment further eliminates the need for external plastic enclosures and the need to modify the power plug or end connector. Alternatively, the rectifier diodes could be placed outside the sockets shown, and inline with the lamp assemblies, allowing for the reduction of wire, which reduces cost and bulkiness for end-connected sets where the output is required to be 120 VAC.

In one embodiment, the first and last two LEDs per LED string will be powered by a half-wave rectified AC signal, while the intermediate LEDs will be powered by full-wave rectified power. As such, the first two LEDs and the last two LEDs may exhibit a limited amount of visible flicker, while the intermediate LEDs exhibit little, if any, flicker. For example, for a 60 LED string, there are four LEDs that exhibit visible flicker in single-circuit sets, and eight LEDs that exhibit visible flicker for double-circuit sets. This avoids the use of a large in-line enclosures, such as cylinders, boxes, and soon, allowing for a clean appearance, minimized cost, improved safety, and enhanced appearance and brightness of the LEDs. This embodiment also allows for the operation of LEDs that have DC-power-only components bundled with them to properly operate.

The present invention may be used in series or series-parallel connected illumination products (decorative or general use) where flickering is caused by low frequency utility power, such as 50 or 60 hertz common in the United States and other countries. Typical applications would be in LED products or other products where DC enhances the operation of a light source.

Figure 4:
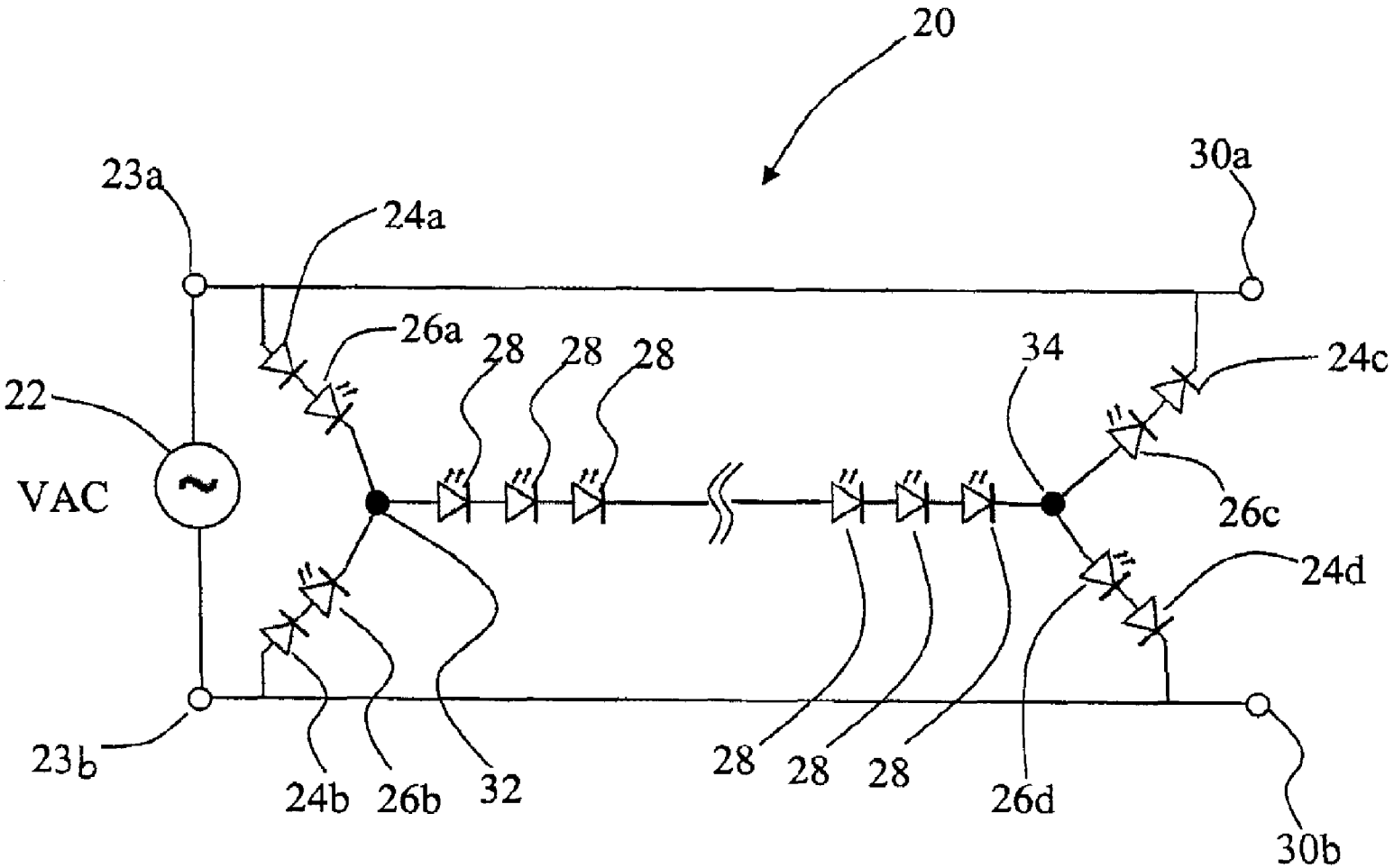
FIG. 4 is a circuit diagram of one embodiment of a limited-flicker LED string of the present invention with circuitry providing full-wave rectification to only a portion of the LEDs.

Referring to FIG. 4, a circuit diagram of one embodiment of a limited flicker LED string 20. The depicted embodiment of LED string 20 includes an AC power source 22, power terminals 23*a* and 23*b*, rectifying diodes 24*a*-24*d*, feed LEDs 26*a*-26*d*, multiple main LEDs 28, and optional end-connect power terminals 30.

The anode of rectifying diode 24*a* is connected electrically to power terminal 23*a* of AC power source 22, while the cathode of rectifying diode 24*a* is connected to the anode of feed LED 26*a*. As such, rectifying diode 24*a* is electrically in series with feed LED 26*a*. In other embodiments, the relative positions of rectifying diodes 24 and 26 may be reversed without affecting the operation of LED string 20.

The anode of rectifying diode 24*b* is connected electrically to power terminal 23*b* of AC power source 22, while the cathode of rectifying diode 24*b* is connected to the anode of feed LED 26*b*. As such, rectifying diode 24*b* is electrically in series with feed LED 26*b*.

The cathodes of LED 26*a* and LED 26*b* are electrically connected at junction 32. Also connected to junction 32 is the anode of a first main LED 28. Multiple main LEDs 28 are connected in series to form a LED series ending in a last main LED 28 having its cathode connected to a junction 34. The anodes of feed LED 26*c* and LED 26*d* are connected to the cathode of the last main LED 28 at junction 34. The number of main LEDs 28 will vary depending on the electrical characteristics of the main LEDs, voltage characteristics of AC power source 22, and other factors discussed below. Further, multiple LED series wired in parallel and connected to junctions 32 and 24 may be used.

The cathode of feed LED 26*c* is connected to the anode of rectifying diode 24*c*, while the cathode of rectifying LED 24*c* is connected to the first terminal of AC power source 22 and an optional end connect terminal 30*a*. The cathode of feed LED 26*d* is connected to the anode of rectifying diode 24*d*, while the cathode of rectifying LED 24*d* is connected to the second terminal of AC power source 22, and an optional end connect terminal 30*b*.

In other embodiments, the anode side and cathode side of all diodes may be reversed.

The output of AC power source 22 in one embodiment is a 60 Hz sinusoidal 110 VAC to 125 VAC signal as is typically found in the United States. In other embodiments, the supplied frequency and voltage may vary, dependent on the power standards of the region. For example, in some embodiments, AC power source 22 may be a 50 Hz, 220 VAC power source.

LEDs 26 and 28 may be any of a variety of light-emitting diodes as commonly known and used in the lighting industry. As the operating characteristics of LEDs 26 and 28 vary with color, type, and so on, the number of LEDs 28 used in a single LED string 20 will also vary. For example, for LEDs 26 and 28 operating at 2.2 volts each and powered by 110 VAC, a single circuit LED string 20 may include approximately 50 LEDs total.

Rectifying diodes 24 may be any standard rectifying diode known in the industry, including surface-mount diodes, and are selected to accommodate the voltage and current requirements of each particular LED string 20. Alternatively, LEDS 26*a*-26*d* with sufficient rectifying properties could be used without series-connected rectifying diodes 24*a*-24*d*.

Further, although only one circuit is depicted and described in FIG. 4, LED string 20 may include several circuits connected in series, each containing multiple rectifying diodes 24 and LEDs 26 and 28. Alternatively, multiple LED series may be connected in parallel with each other.

In operation, generally speaking, main LEDs 28 remain lighted throughout nearly the entire AC power cycle, while LEDs 26 are lighted throughout approximately half of each power cycle.

When AC power source 22 outputs a sinusoidal voltage and current, a positive voltage is applied to power terminal 23*a* and a negative voltage at power terminal 23*b* during the first, or "positive" half of the power cycle. Current flows through rectifying diode 24*a*, feed LED 26*a*, main LEDs 28, then through feed LED 26*d* and rectifying diode 24*d*, to terminals 30*b* and 23*b*. As will be understood by those skilled-in-the-art, LEDs 26*a*, 28, and 26*d* remain unlit, and current does not flow, until the voltage at each diode exceeds the threshold voltage of the diode. Once the threshold voltage is reached, each diode, rectifying and LED, conducts. Similarly, as the voltage and current decreases with the power cycle, each LED will turn off when the voltage drops below its threshold voltage.

Throughout the "positive" half of the power cycle, rectifying diodes 24*b* and 24*c* are reverse biased and do not conduct. Similarly, feed LEDs 26*b* and 26*c* are also reverse biased, do not conduct, and remain unlit.

During the second, or "negative", half of the power cycle, a negative voltage is applied to power terminal 23*a* and a positive voltage at power terminal 23*b*. After the voltage surpasses the threshold voltage of the LEDs, current flows through rectifying diode 24*b*, feed LED 26*b*, LEDs 28, feed LED 26*c*, and rectifying diode 24*c*, thereby causing LEDs 26*b*, 28, and 26*c* to emit light.

Throughout the negative half of the power cycle, rectifying diodes 24*a* and 24*d* are reverse biased and do not conduct. Similarly, feed LEDs 26*a* and 26*d* are also reverse-biased, do not conduct, and remain unlit.

Therefore, in this embodiment, main LEDs 28 are lit during a portion of both the positive and negative halves of the power cycle, while feed LEDs 26*a* and 26*d* are lit for a portion of a one-half of the power cycle, and feed LEDs 26*b* and 26*c* are lit for a portion of the other half of the power cycle.

Figure 5:
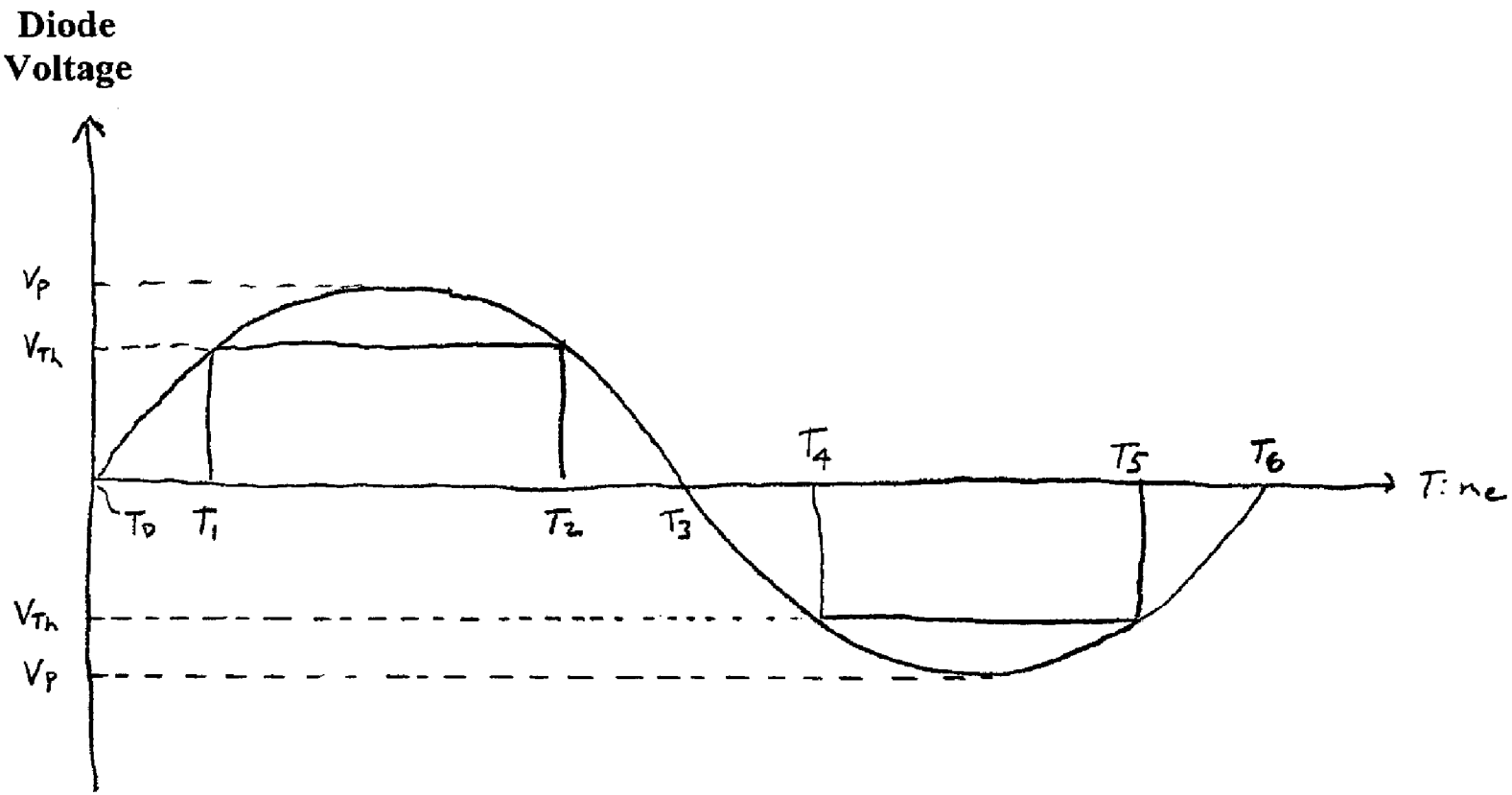
FIG. 5 is a graph of voltage versus time for a rectifying or light-emitting diode of a limited flicker light string of the present invention.

Referring now to FIG. 5, a graph depicting diode voltage versus time for one full power cycle is depicted. The term diode here refers to any of rectifying diodes 24, or LEDs 26 and 28. Time is represented on the horizontal axis of the graph of FIG. 5, with the positive half of the power cycle occurring from time T0 to T3, and the negative from T3 to T6. Diode voltage is represented on the vertical axis. Vp is the peak voltage seen at any individual diode; Vth is the threshold voltage at any individual diode. Vth is also the point at which diodes 24, LEDs 26, and LEDs 28 begin to conduct. Vp and Vth will vary depending on the particular characteristics of the individual rectifying or light-emitting diode. However, for explanatory purposes, rectifying diodes 24 and LEDs 26 and 28 will be assumed to have the same threshold and peak voltages, though it will be understood that each diode may have different peak and threshold values.

Still referring to FIG. 5, the voltage across rectifying diodes 24*a*, 24*d*, and LEDs 26*a*, 28, and 26*d* will rise from zero volts at time T0, to positive threshold values Vth at time T1. At that point, the diodes begin to conduct, and LEDs 26*a*, 28, and 26*d* emit light. At the same time, rectifying diodes 24*b* and 24*c*, along with LEDs 26*b* and 26*c* are reverse biased, and therefore do not conduct or emit light.

Rectifying diodes 24*a*, 24*d*, and LEDs 26*a*, 28, and 26*d* continue to conduct as the voltage stays above Vth from time T1 to time T2. At time T2, the voltage at rectifying diodes 24*a*, 24*d*, and LEDs 26*a*, 28, and 26*d* falls below their respective threshold voltages, and they stop conducting.

From time T2 until time T4, no diodes in LED string 20 conduct, and the set remains unlit.

During the negative half of the power cycle, power terminal 23*a* has a negative voltage, and power terminal 23*b* has a positive voltage. As such, rectifying diodes 24*a*, 24*d*, and LEDs 26*a* and 26*d* are reverse biased and do not conduct. However, during the negative half of the power cycle, rectifying diodes 24*b*, 24*c*, and LEDs 26*b*, 28, and 26*c* are forward biased, and do conduct when the voltage across each diode reaches its respective threshold voltage. Therefore, from time T4 to time T6, rectifying diodes 24*b*, 24*c*, and LEDs 26*b*, 28, and 26*c* conduct, and LEDs 26*b*, 28, and 26*c* remain lit. At time T5, the diode voltage falls "below" Vth, and LEDs 26*b*, 28, and 26*c* cease emitting light.

This cycle repeats itself, with main LEDs 28 lighting on and off during each half-cycle, and half of feed LEDs 26 lighting during each half-cycle. As such, LEDs 28 "flicker" at a frequency that is approximately twice the frequency of the power cycle, e.g., a flicker rate of 120 Hz for a 60 Hz AC power supply. LEDs 26 will flicker at a rate approximately the same as the power supply, e.g., at approximately 60 Hz for a 60 Hz AC power supply 22. In one embodiment, the time that LEDs 26 an 28 remain lit is greater than the time LEDs 26 and 28 are unlit, respectively.

From a flickering standpoint, and as compared to prior art AC operated LED strings that do not provide any rectification and flicker at a rate of equal to the frequency of the power supply, such as the example depicted in FIG. 1, this represents a significant improvement. Because the human eye becomes less and less able to detect the turning on and off of the LEDs at higher and higher frequencies, the increased flicker rate of LEDs 28, and of limited flicker LED string 20, becomes virtually imperceptible.

Figure 6:
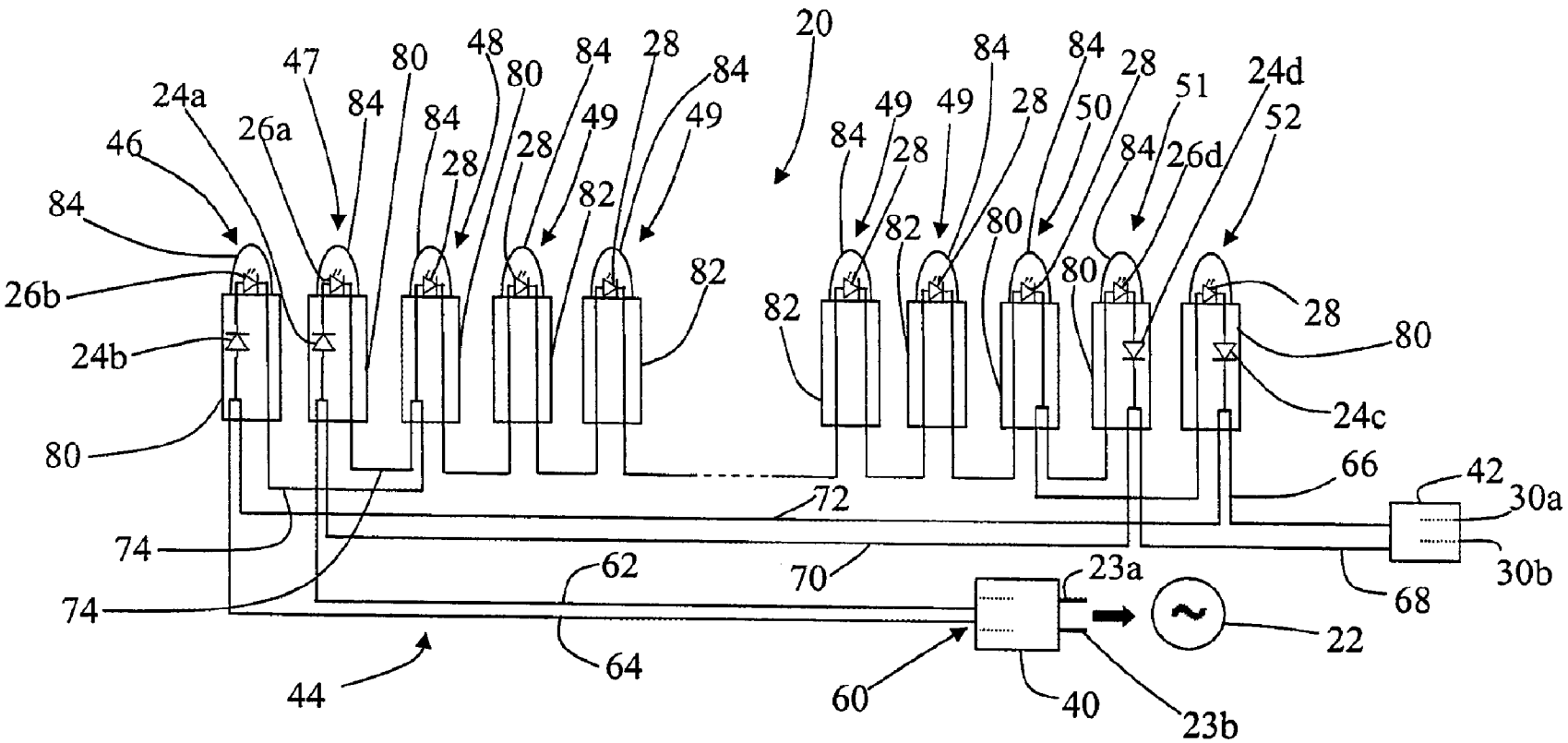
FIG. 6 is a front view of one embodiment of a limited-flicker LED string of the present invention depicting the location of circuit elements in relation to the wires, lamp assemblies, and power plugs.

Referring now to FIG. 6, other important advantages of LED string 20 become apparent when considering the implementation of the circuit of FIG. 4 into an actual LED string. In this embodiment, limited flicker LED string 20 includes all of the electrical components of the circuit depicted in FIG. 4. More specifically, LED string 20 includes power plug 40, optional end connect 42, wire set 44, and bulb assemblies 46 to 52.

In one embodiment, power plug 40 is a standard power plug as known and used in the decorative lighting industry, and that may be inserted into an AC power source 22. Power plug 40 includes a pair of power terminals 23*a* and 23*b*, and optional current tap 60. If present, current tap 60 may be a standard current tap that allows a second light string to be inserted into power plug 40, such that it is electrically connected to AC power source 22.

Wire set 44 includes: lead wires 62 and 64; end-connect wires 66, 68, 70 and 72; and multiple bulb connector wires 74. Lead wires 62 and 64 connect power terminals 23*a* and 23*b* to bulb assemblies 46. In embodiments that include an end connect 42, end-connect wires 66 to 68 electrically connect AC power source 22 to terminals 30*a* and 30*b*, making AC power available to a second decorative light string that may be plugged into end connect 42. In this embodiment, end-connect wires 66 and 68 are relatively short, while end-connect wires 70 and 72 are relatively long. Bulb connector wires 74 provide electrical connections between the electrical components of the various bulb assemblies 46 to 52. The connections for wires 62, 72, 66, and 62, 70, 68, could alternatively be made in power plug 40 and end connect 42, respectively.

In this embodiment, each bulb assembly 46 to 52 includes a three-wire socket 80 or two-wire socket 82, an LED lens 84, an LED 26 or 28, and may also include a rectifying diode 24. Sockets 80 and 82 also include junctions or wire terminals for connecting wires and electrical components within sockets 80 or 82 as described in further detail below.

More specifically, in the embodiment depicted, bulb assembly 46 includes three-wire socket 80, lens 84, rectifying diode 24*a*, and LED 26*a*; bulb assembly 47 includes three-wire socket 80, lens 84, rectifying diode 24*b*, and LED 26*b*; bulb assembly 48 includes three-wire socket 80, lens 84, and LED 28; bulb assemblies 49 include two-wire sockets 82, lenses 84, and LEDs 28; bulb assembly 50 includes three-wire socket 80, lens 84, and LED 28; bulb assembly 51 includes a three-wire socket 80, lens 84, rectifying diode 24*d*, and LED 26*d*; bulb assembly 52 includes three-wire socket 80, lens 84, rectifying diode 24*c*, and LED 26*c*. Other wiring configurations may be used in other embodiments.

Figure 7:
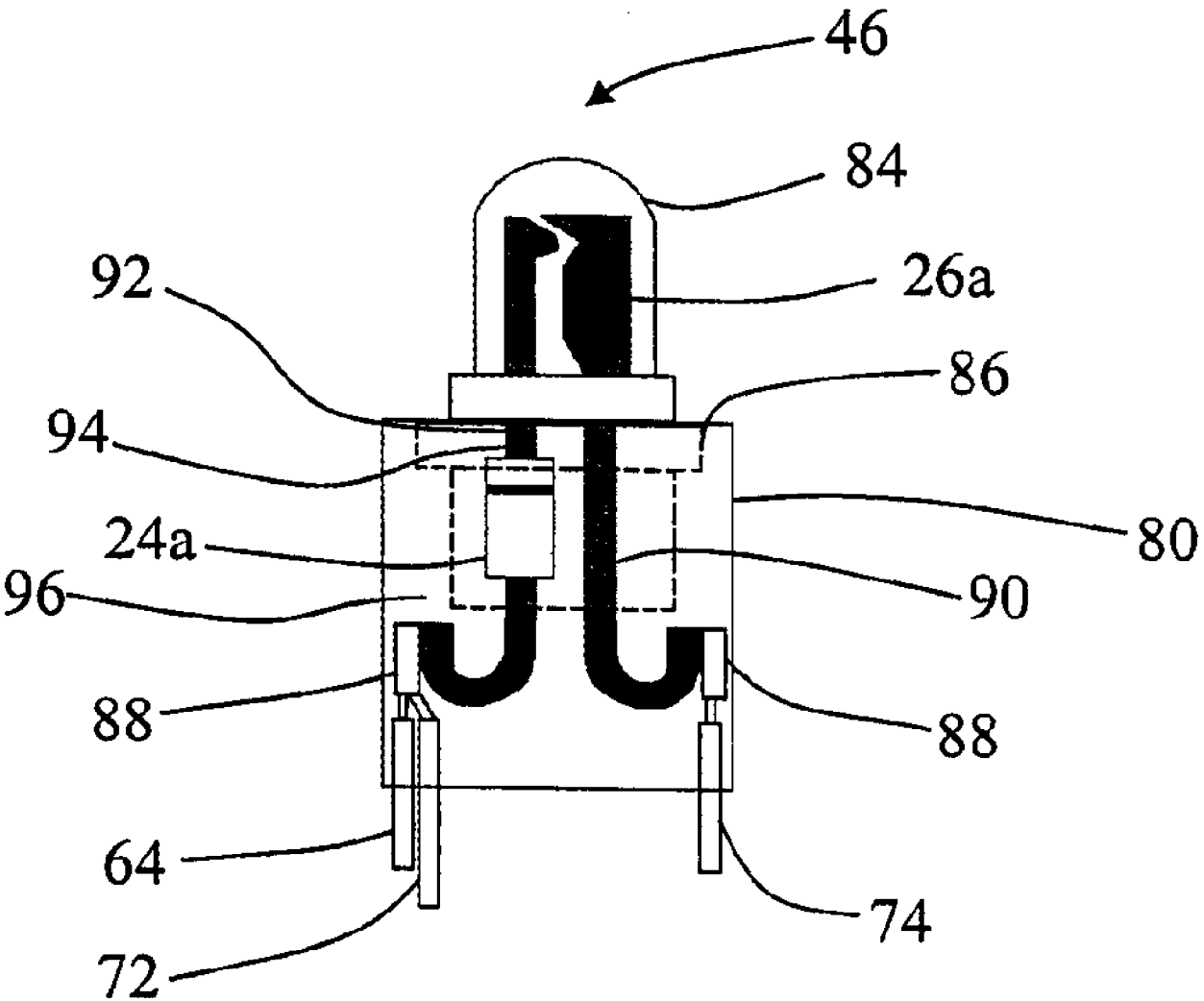
FIG. 7 is a front, partial cross-sectional view of one embodiment of an LED lamp assembly of a limited-flicker LED light string of the present invention.

Referring now to FIG. 7, bulb assembly 46 is depicted in greater detail. Although FIG. 7 specifically depicts bulb assembly 46, the described properties and attributes of bulb assembly 46 apply equally to bulb assemblies 47 to 52 with the exception of the specific electrical components, wire quantity, and socket type included in the assembly.

As depicted, LED 26*a* is housed in lens 84. Lens 84 may comprise an optical grade epoxy or other material such as glass, plastic, or otherwise. Lens 84 may be dome shaped as depicted, or may be take other shapes such as squares, stars, hearts, and so on. Alternatively, lens 84 may be replaced by, or used in conjunction with, a decorative cover.

LED 26*a* may emit any color light which may be continuous, intermittent, blinking, or otherwise non-continuous. Further, LED 26*a* may be color changing, and may contain multiple LEDs connected in parallel.

LED lens 84 with LED 26*a* may be inserted into an optional base 86, then inserted into socket 80 such that LED anode lead 92 and cathode lead 90 protrude through lens 84 and downward into socket 80.

In this embodiment, bulb assembly 46 includes three-wire socket 80 that is capable of receiving three wires. In other embodiments, bulb assembly 46, or similar bulb assemblies, may include a two-wire socket 82 that is capable of receiving two wires. Sockets 80 and 82 may be standard two- and three-wire sockets as are well known in the art. A standard end-connected decorative light string uses two three-wire sockets, one closest to power plug 40 and one closest end connect 42. For an embodiment without an end connector, the first and last two lamp assemblies need only use two-wire sockets as an output power connection is not needed.

Still referring to FIG. 7, cathode lead 94 of rectifying diode 24*a* is connected to anode lead 92 within socket 80. This connection may be made through soldering, twisting, crimping, welding, pressing, or otherwise bringing the two leads into contact.

Anode lead 96, wire 64, and wire 72 are electrically connected within socket 80. Wires 64 and 72, and other wires, may each include a terminal 88 connected to the end of each wire. Alternatively, wires 64 and 72 may both be connected to a single terminal 88. An electrical connection may be made by press fitting terminal(s) 88 and lead 96 into a cavity within an inner wall of socket 80, or the connection may be made through soldering, twisting, crimping, pressing, welding or otherwise.

Cathode lead 90 is electrically connected to wire 74 directly, or via terminal 88 as depicted in FIG. 7. An electrical connection may be made by press fitting terminals 88 and lead 90 into a cavity within an inner wall of socket 80, or the connection may be made through soldering, twisting, crimping, pressing, or otherwise.

In addition to the benefit of limited flicker as described above, the wiring configuration in combination with the placement of rectifying diodes 24 into standard sockets 80 and 82 provides other benefits not previously available in known LED strings.

First, no additional, potentially non-standard, enclosures are required to house diodes 24. This reduces the overall cost of LED string 20 by eliminating extra enclosures and associated materials, reduces potential regulatory issues, and enhances its appearance.

Second, overall wire length required to produce an end-connected LED string 20 as compared to a standard LED string with a bridge rectifier is reduced. An embodiment of LED string 20 containing end connect 42 requires two relatively long wires, end connect wires 70 and 72. Prior art LED strings using un-split bridge rectifiers require three wires for a single circuit LED string, and four wires for multi-circuit strings.

Third is the exclusive use of standard components such as plugs 40, end connects 42, and sockets 80 and 82. Known LED strings using split rectification, such as the LED string disclosed in Shao, place rectifying diodes in the power plug and in the end connect. Such a configuration not only requires use of non-standard plugs and end connects, but may also preclude integrating a current tap into the power plug. Alternatively it may require large weather-tight external housings to enclose two rectifier diodes, splices and associated strain relief.

Figure 8:
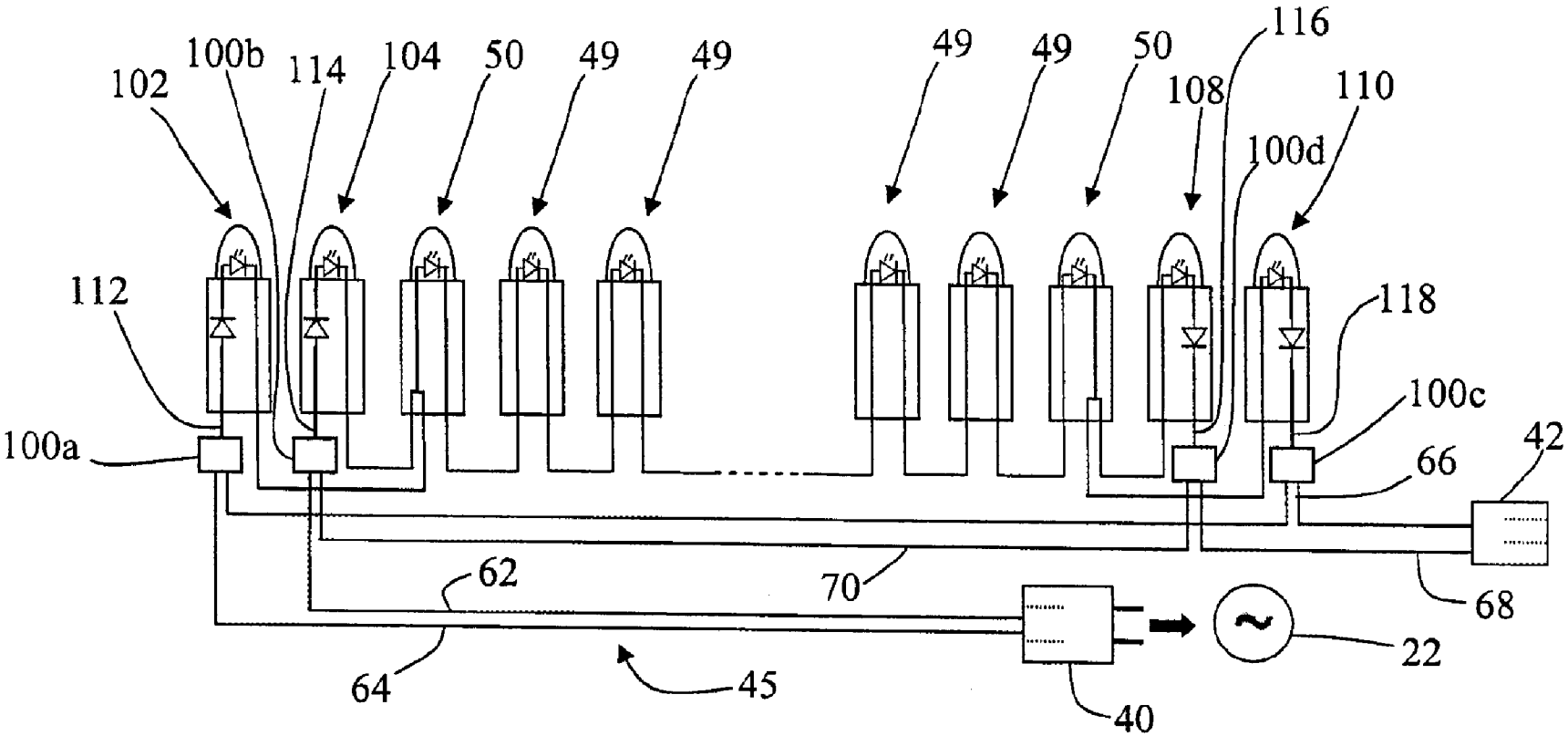
FIG. 8 is a front view of one embodiment of a limited-flicker LED string of the present invention depicting the location of circuit elements in relation to the wires, lamp assemblies, and power plugs, and utilizing small splice compartments.

Referring to FIG. 8, in an alternate embodiment, splice compartments 100 located outside sockets 80 and 82 connect pairs of wires and may house rectifying diodes 24. In this embodiment, LED string 20 includes power plug 40, end connect 42, wire set 45, splice compartments 100, and bulb assemblies 102 to 110.

In this embodiment, bulb assembly 102 includes three-wire socket 80, lens 84, rectifying diode 24*b*, and LED 26*b*; bulb assembly 104 includes three-wire socket 80, lens 84, rectifying diode 24*a*, and LED 26*a*; bulb assembly 108 includes three-wire socket 80, lens 84, rectifying diode 24*d*, and LED 26*d*; bulb assembly 110 includes three-wire socket 80, lens 84, rectifying diode 24*c*, and LED 26*c*. Other wiring configurations may be used in other embodiments.

Splice compartments 100 comprise a small enclosure or other device for receiving the ends of a pair of incoming wires, electrically connecting the incoming wires with an outgoing wire, within the enclosure. Electrical connections within splice compartment 100 may be made by soldering, twisting, or by other known methods of electrically connecting wires.

In the embodiment depicted in FIG. 8, four splice compartments 100 receive eight incoming wires from wire set 45, and output four single wires, each to a respective bulb assembly. More specifically, splice compartment 100*a* receives lead wire 64 and end connect wire 72, and outputs a single wire 112 to bulb assembly 102. Similarly, splice compartment 100*b* receives lead wire 62 and end connect wire 70, and outputs a single wire 114 to bulb assembly 104; splice compartment 100*d* receives end connect wires 68 and 70, and outputs a single wire 116 to bulb assembly 108; splice compartment 100*c* receives an intermediate wire 72 and end connect wire 66, and outputs a single wire 118 to bulb assembly 110. In an alternate embodiment splice compartments are used with bulb assemblies 50.

The use of splice compartments 100 ensures reliable electrical connection points between wire set 45 and rectifying diodes 24 in part by reducing the number of incoming wires from three to two for most sockets 80, and by reducing the number of wires connecting to rectifying diodes 24 from two to one. Reducing the number of wires entering lamp assemblies 102, 104, 108 and 110 also facilitates manufacturing by increasing the working space, and decreasing the complexity of electrically connecting wires and terminals to rectifying diodes 24.

In an alternate embodiment, rectifying diodes 24 may be located within splice compartments 100. Such an embodiment provides the benefits described above, and further facilitates manufacturing by placing rectifying diodes into a more easily accessible location, thereby allowing standard manufacturing techniques to be used for assembling bulb assemblies 104 to 110.

Figure 9:
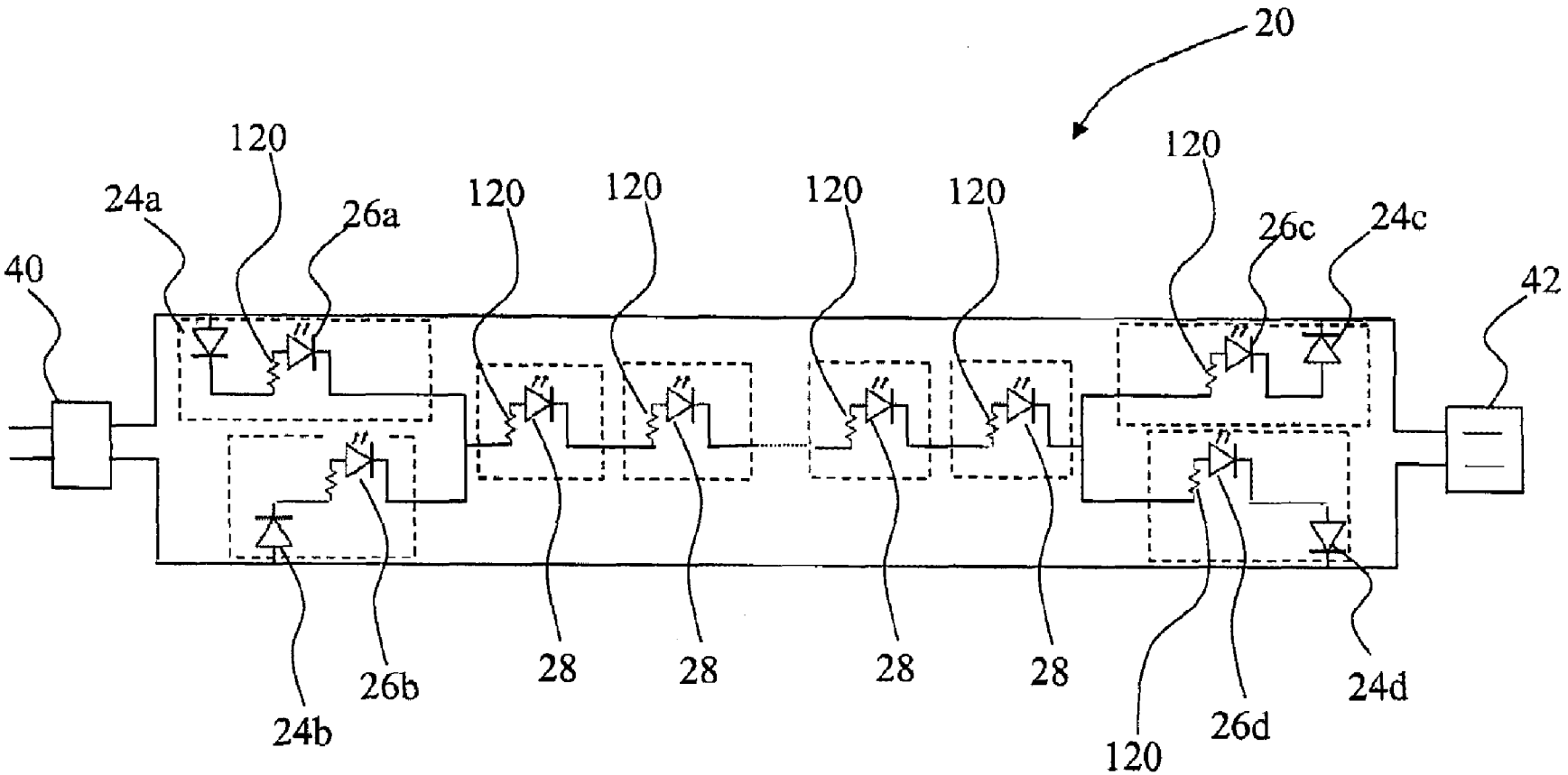
FIG. 9 is a circuit diagram of one embodiment of an AC-operated LED string of the present invention with circuitry providing full-wave rectification to only a portion of the LEDs, and with current-limiting circuitry.

Referring to FIG. 9, in another embodiment, LED string 20 includes one or more current-limiting devices. In the embodiment depicted in FIG. 9, resistors 120 act as current-limiting devices, though other current-limiting devices may be used in other embodiments. This embodiment of LED string 20 includes all of the components of LED string 20 as described with respect to FIGS. 4-6, and also includes current-limiting resistors 120 located within the bulb assemblies, and optionally, within lens 84. Although LED string 20 as depicted in FIG. 9 illustrates a resistor 120 for each LED 26 and 28, fewer current-limiting resistors 120 may be used. In this embodiment, current limiting resistors 120 may be a surface-mount resistor electrically connected in series to its respective LED 26 or 28, and located within lens 84 and adjacent the LED. Current limiting resistors 120 may be connected to the anode of its respective LED 26 or 28 as depicted, or may alternately be connected to the cathode of its respective LED 26 or 28.

Figure 10:
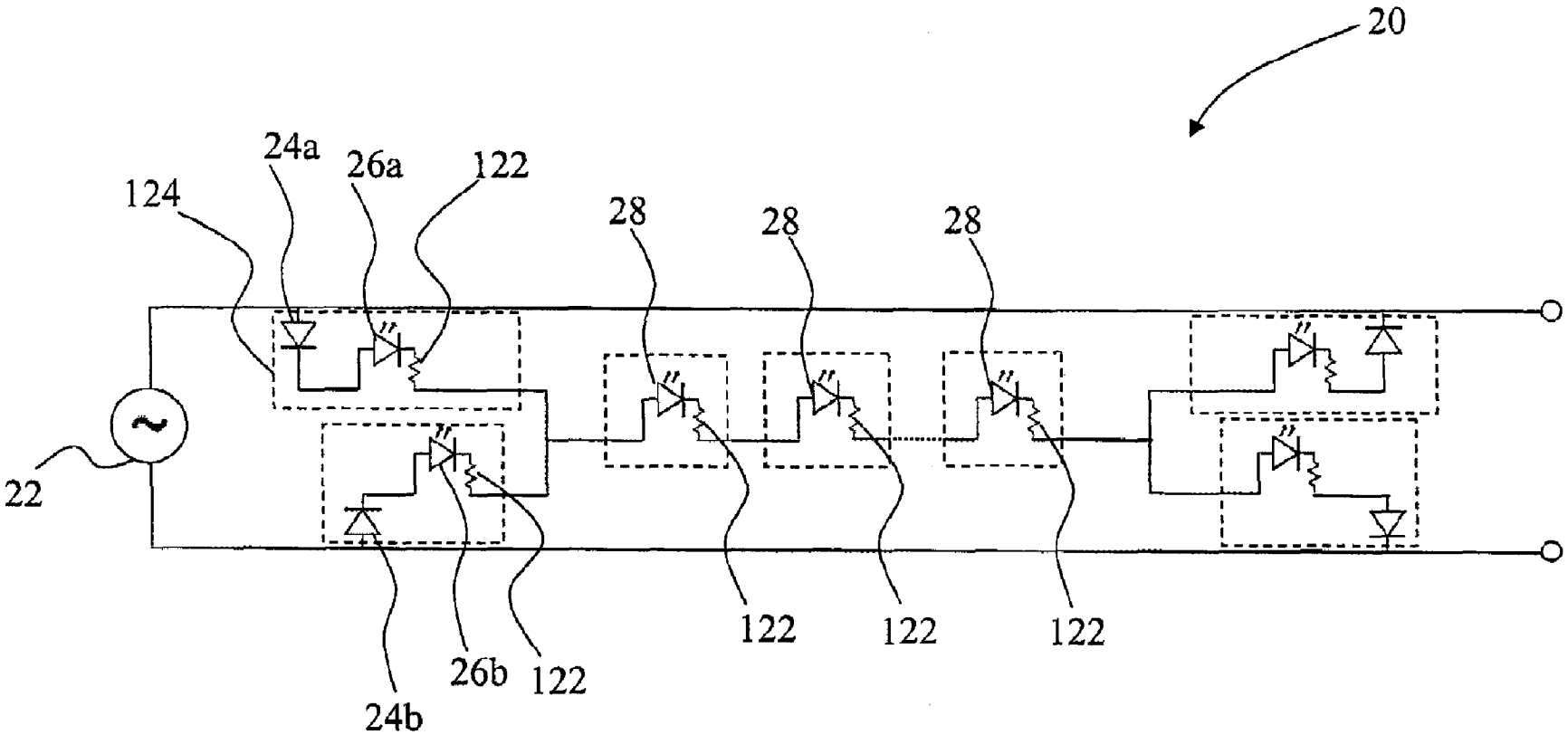
FIG. 10 is a circuit diagram of another embodiment of an AC-operated LED string of the present invention with circuitry providing full-wave rectification to only a portion of the LEDs, and with current-limiting circuitry.
Figure 11:
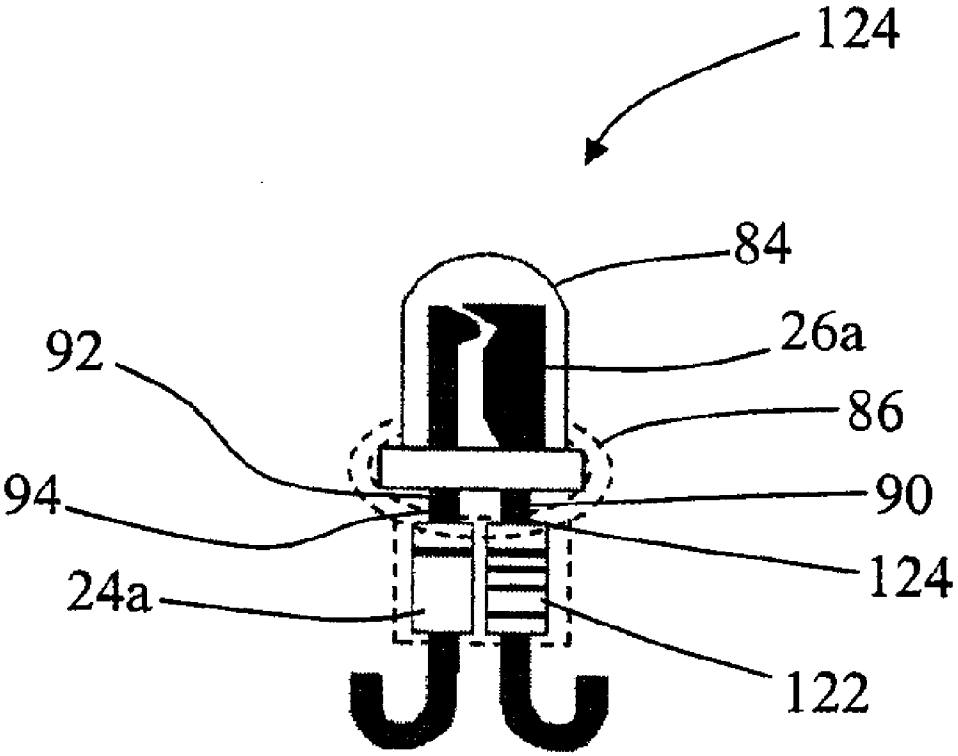
FIG. 11 is a front, partial cross-sectional view of an LED lamp assembly of a limited flicker LED light string of the present invention that includes a rectifying diode and current-limiting resistor located in the lamp socket.

Referring to FIGS. 10 and 11, LED string 20 may include current-limiting devices, such as depicted current limiting resistors 120, located within socket 82 or 80. In this embodiment, the cathode of diode 24 is connected the anode of LED 26 as before. In addition, lead 124 of resistor 124 is connected to the cathode lead 90 of diode 26.

Embodiments of the invention as described above therefore address and resolve many of the deficiencies and drawbacks previously identified. The invention may be embodied in other specific forms without departing from the essential attributes thereof; therefore, the illustrated embodiments should be considered in all respects as illustrative and not restrictive. For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A decorative LED string, comprising: a first power terminal and a second power terminal; a first diode, wherein an anode of the first diode is electrically connected to the first power terminal; a second diode, wherein an anode of the second diode is electrically connected to a cathode of the first diode; a third diode, wherein an anode of the third diode is electrically connected to the second power terminal; a fourth diode, wherein an anode of the fourth diode is electrically connected to a cathode of the third diode, and a cathode of the fourth diode is electrically connected to a cathode of the second diode; a fifth diode, wherein a cathode of the fifth diode is electrically connected to the first power terminal; a sixth diode, wherein a cathode of the sixth diode is electrically connected to an anode of the fifth diode; a seventh diode, wherein a cathode of the sixth diode is electrically connected to the second power terminal; an eighth diode, wherein a cathode of the eighth diode is electrically connected to an anode of the seventh diode, and an anode of the eighth diode is electrically connected to an anode of the sixth diode; a plurality of LEDs electrically connected in series to form an LED series, wherein a first LED of the LED series is electrically connected to the second diode and to the fourth diode, and a last LED of the LED series is electrically connected to the sixth diode and the eighth diode.

2. The LED string of claim 1, wherein at least some of said diodes are rectifying diode and wherein said string includes bulb assembly sockets and wherein said rectifying diodes are in said sockets.

3. The LED string of claim 2, wherein the bulb assembly sockets are three-wire sockets.

4. The LED string of claim 2, wherein at least some of the rectifying diodes are LEDs.

5. The LED string of claim 1, further comprising a current-limiting device electrically connected in series with at least one diode.

6. The LED string of claim 5, wherein the current-limiting device is surface-mount current-limiting device encased in an LED lens.

7. The LED string of claim 5, wherein the current-limiting device is located in said socket.

8. The LED string of claim 5, wherein the current-limiting device is a resistor.

9. The LED string of claim 1, wherein the LEDs emit more than one color of light.

10. The LED string of claim 1, further comprising: a plurality of bulb assemblies, wherein each bulb assembly includes a socket and at least one LED, wherein each socket is adapted to receive either two or three wires; a wire set electrically connecting the power plug, rectifying diodes, and LEDs; and a plurality of splice compartments, wherein the splice compartment is adapted to receive two wires of the wire set, output a single wire of the wire set, and electrically all three wires such that the number of wires entering the socket is reduced.

11. The LED string of claim 10, wherein at least one rectifying diode is located within at least one of the plurality of splice compartments.

12. The decorative LED string of claim 1, wherein the first, third, fifth, and seventh diodes are rectifying diodes.

13. The decorative LED string of claim 1, wherein the second, fourth, fifth, sixth, and eighth diodes are LEDs.

14. The decorative LED string of claim 1, wherein the first, second, third, fourth, fifth, sixth, and seventh and eighth diodes are LEDs, and at least one LED in each of the diode pairs acts as a rectifying diode.

15. The decorative LED string of claim 1, wherein the first, third, fifth, and seventh diodes are rectifying diodes.

16. The decorative LED string of claim 1, wherein the first, third, fifth, and seventh diodes are LEDs.

* * * * *